US006418936B1

(12) United States Patent
Lee

(10) Patent No.: US 6,418,936 B1
(45) Date of Patent: Jul. 16, 2002

(54) TOBACCO PIPE

(75) Inventor: Jake Lee, Los Angeles, CA (US)

(73) Assignee: Sandia Corp., Livermore, CA (US)

( * ) Notice: Subject to any disclaimer, the term of this patent is extended or adjusted under 35 U.S.C. 154(b) by 0 days.

(21) Appl. No.: 09/570,114

(22) Filed: May 12, 2000

Related U.S. Application Data

(60) Provisional application No. 60/134,036, filed on May 14, 1999.

(51) Int. Cl.[7] ..... A24F 1/00

(52) U.S. Cl. ..... 131/180; 131/330; 131/178; 131/220; 131/223; 131/226; 131/200

(58) Field of Search ..... 131/329, 330, 131/178, 180, 220, 222, 223, 224, 225, 230, 226, 205, 206

(56) References Cited

U.S. PATENT DOCUMENTS 682,278 A * 9/1901 Roller
1,302,047 A * 4/1919 Hurst
1,564,858 A * 12/1925 Kloppman
1,976,496 A * 10/1934 Harris
2,209,441 A * 7/1940 Blum
2,329,578 A * 9/1943 Andis
2,603,216 A * 7/1952 Taplin et al.
2,624,345 A * 1/1953 Rosenthal
2,688,330 A * 9/1954 Forbes
3,326,360 A * 6/1967 Lyon
3,463,166 A * 8/1969 Bennett et al.
3,589,375 A * 6/1971 Pekrul ..... 131/205
3,863,649 A * 2/1975 Scharfy ..... 131/192
3,870,192 A * 3/1975 Haley ..... 221/186
4,026,019 A * 5/1977 Schiffman ..... 131/225
4,105,027 A * 8/1978 Lundquist ..... 12/206
4,171,703 A * 10/1979 Locke ..... 131/173
4,193,411 A * 3/1980 Faris et al. ..... 131/171
4,224,953 A * 9/1980 Alvarez ..... 131/179
4,307,734 A * 12/1981 Blankenship ..... 131/329
4,527,571 A * 7/1985 Djukic ..... 131/329
4,579,128 A * 4/1986 Ball ..... 131/201
4,703,766 A * 11/1987 Wargo ..... 131/175

FOREIGN PATENT DOCUMENTS

FR 640275 * 7/1928
FR 699916 * 2/1931
FR 1031850 * 6/1953

* cited by examiner

*Primary Examiner*—Jose Fortuna
*Assistant Examiner*—Carlos Lopez
(74) *Attorney, Agent, or Firm*—Frank L. Zugelter

(57) ABSTRACT

A tobacco pipe (10) having a hollow stem (12) threaded to a manifold (20) on top of which a turret (30) is rotatably mounted. Turret (30) is of greater weight than that of manifold (20), so that any one of a plurality of turret magazines (33) remains stationary over a chamber (24) in the manifold (20) in their relative rotation, so that smoking tobacco in the aligned magazine (33) with such chamber (24) takes place through the hollow stem (12). A screen (28) seats in a recess 27 of a port (25) of manifold (20) at a sufficient distance from the turret's chamber (24), preventing scorching of screen (28) by a source of flame at/in chamber (24) in the aligned magazine (33). A member (37) is seated in a cavity (38) co-extensive between and within turret (30) and manifold (20), and includes a bearing surface (42) that abuts a bearing surface (41) in turret (30) and includes threads (48) disposed within manifold (20) and threads (49) in turret (30) for fastening turret (30) to manifold (20) in an unbinding manner due to the assembly of abutting bearing surfaces (42, 41). A second set of bearing surfaces (46, 45) are provided in member (37) and manifold (20), respectively. Series of fluted surfaces (50, 52) on peripheries (51, 19) of turret (30) and manifold (20) assists in aligning a magazine (33) with chamber (24). Weight of turret (30) over that of manifold (20) maintains a stationary position between the two during a smoking mode. Pipe (10) is free of clogging and residue that otherwise would adhere to screen (28) due to a wide shelf (34) for the magazines (33).

18 Claims, 2 Drawing Sheets

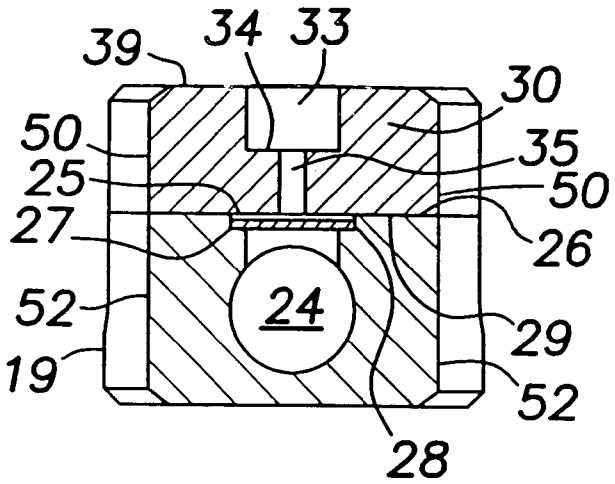
FIG. 5
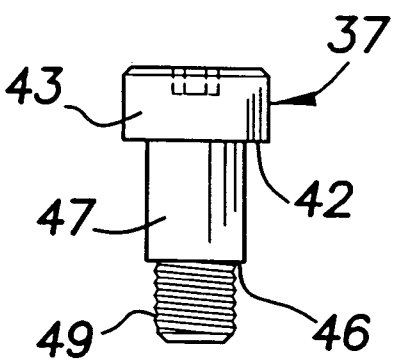
FIG. 7
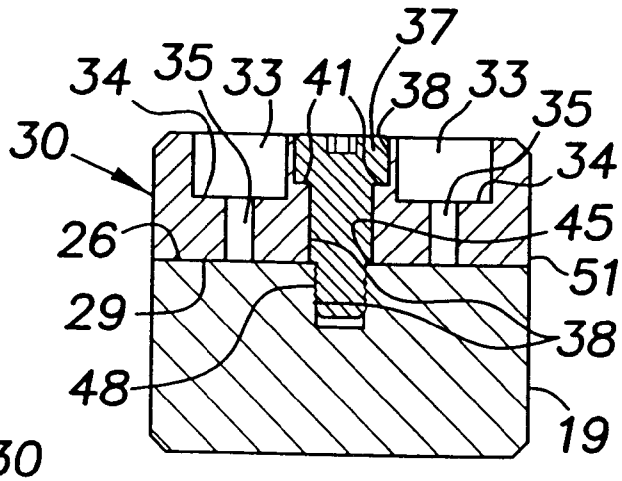
FIG. 4
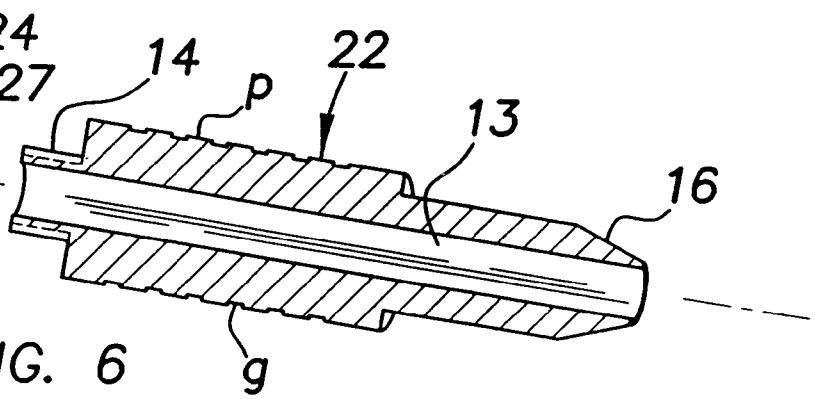
FIG. 6
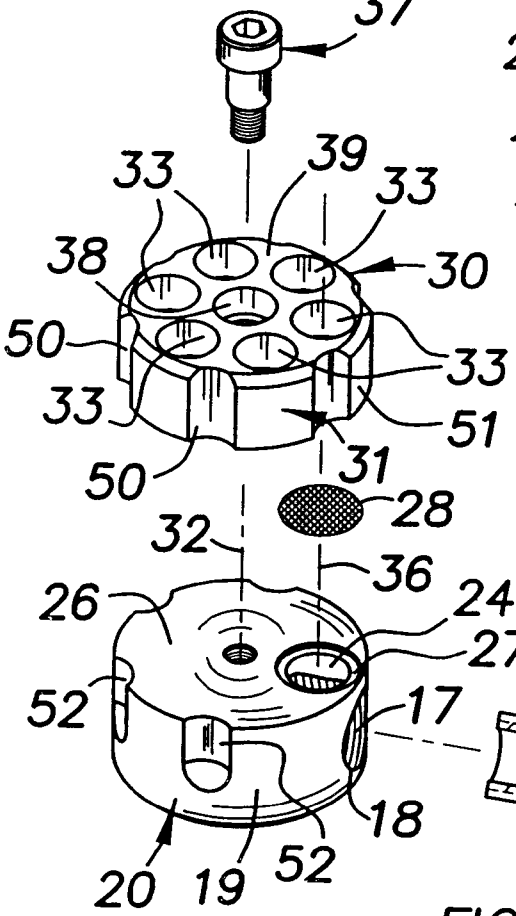

TOBACCO PIPE

This invention is related to provisional application serial No. 60/134,036, filed May 14, 1999.

TECHNICAL FIELD

This invention is directed to a tobacco pipe and in particular is directed to an improvement in a magazine-type pipe by which more than one magazine or chamber for tobacco is available and from any one of which the smoke of the tobacco can be inhaled.

BACKGROUND TO THE INVENTION a) Prior Art Teachings

The U.S. patents to Hurst [U.S. Pat. No. 1,302,047, granted Apr. 29, 1919] and Locke [U.S. Pat. No. 4,171,703, granted Oct. 23, 1979] disclose tobacco pipes that include within their bowls a plurality of magazines or chambers for containing tobacco, with any one of the magazines being serially communicable with smoke passages through which the smoke of the burning tobacco can be inhaled. In Hurst, each magazine communicates with a smoke passage in a base and which in turn communicates with a smoke passage in a hollow stem through which smoke is inhaled. A pivot pin rotatably secures the bowl and base together, and further requiring spring and packing members to assure smoke-tight registry of and good seals between aligned passages and openings between the communicating one of the magazines and the pipe's hollow stem. A nicotine-drain chamber or cup communicates with the hollow stem. In the portion of the bong or water pipe of Locke which appears to be relevant to the instant invention, a cotter pin rotatably joins together a base and turret, the turret containing a plurality of smoking-substance members threaded into a cylindrical base that is friction-fitted onto a smoke conduit in the bong or water pipe.

Disclosures of other smoking pipe teachings are found in U.S. Pat. Nos. 682,278; 1,050,005; and 2,533,956.

b) Problems in the Prior Art

The above disclosures, briefed to the relevant extent necessary for this disclosure, do not address features in this invention, for example, of a weighted bowl or turret relative to its base, a member that not only fastens together a turret to a manifold but also provides one or more bearing relationships between the two which prevents a binding relationship between the two that would circumvent operation of the invention, a single screen that filters ash/residue from the manifold and which serves a plurality of magazines in the turret although only one of them is aligned properly over the screen in the manifold for smoking the tobacco in the aligned magazine, the screen setting a sufficient distance from the burning tobacco and its burning source (lighter or match) to prevent its scorching, with one or more of these features in novel combination with one another as well as with other features known in the art.

c) Need for Invention

Disadvantages in today's metal tobacco pipes is the metal taste in the inhalation of tobacco, the lack of sufficient dissipation of heat from the metal of the pipe, and the clogging of tobacco in passages between the tobacco-burning chamber and the pipe's stem. This invention avoids these disadvantages.

SUMMARY OF THE INVENTION

Briefly, more fully and completely described hereinafter, the invention is incorporated into a tobacco pipe having a weighted turret rotatably mounted on a manifold, a stem for smoking attached to the manifold, a single chamber in the manifold, the turret having a plurality of magazines each capable of being aligned with the manifold's chamber by rotation of turret to manifold, a screen set within a recess of a port in the manifold—at a spacing distinctly distanced from the magazines to prevent scorching, a single joining member that provides one or more bearings to prevent binding between the turret and manifold, as well as fastening them together, all of which contributing to a unique smoking system. The turret is made of material heavier than that of the manifold, such as brass, while the manifold is made of aluminum. As metal is heated, it oxidizes, so brass is used for the turret to remove metal taste from the tobacco smoke being inhaled. The stem has a substantial thicker dimension, that may include additional surface areas over straight cylindrical wall areas of an ordinary metal pipe, to dissipate heat to a greater extent without the pipe getting hotter like other metal pipes in addition to providing a better grip on the pipe by its user. The magazines or chambers in the turret are of a cylindrical dimension, with a squared or 90-degree angled shelf that prevents substantially all of the ash residue from settling upon the lower disposed screen. The life of the single screen considerably spaced from the magazines thus is increased, while being functional for all magazines in the turret rather than making a screen for each magazine.

An object of this invention is to provide a novel metal tobacco smoking pipe.

Another object of the invention is to provide a metal tobacco pipe that does not get hot to an extent that would be uncomfortable or injurious to the smoker holding it while inhaling its smoke.

A further object of the invention is to provide a metal tobacco pipe that eliminates a metal taste from the inhaled smoke.

A still further object of the invention is to prevent clogging in the smoking passages of the metal tobacco pipe.

Yet another object of the invention is to provide an increased period of time between the cleaning of a metal tobacco pipe.

A still further object of the invention is to provide a tobacco pipe more easily assembled and disassembled, for cleaning, repairing, and the like.

These and other objects and advantages will become more apparent upon a complete and fall reading of the following description, the appended claims thereto and the accompanying drawing comprising two (2) sheets of seven (7) FIGURES of the preferred embodiment.

BRIEF DESCRIPTION OF THE FIGURES.

FIG. 4 is a cross-sectional view taken on line 4—4 of FIG. 1.

Figure 2:
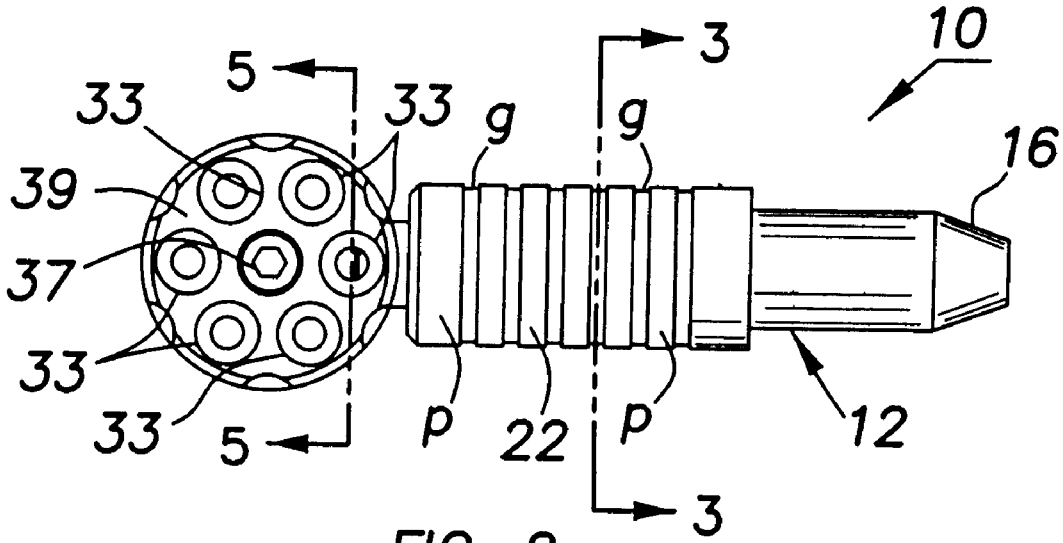
FIG. 2 is a plan view of the pipe of FIG. 1.

FIG; 5 is a cross-sectional view taken on line 5—5 of FIG. 2.

FIG. 6 is an exploded perspective view of the five (5) elements, one of which being shown in cross-section, forming the preferred embodiment.

FIG. 7 is an elevational view of one of the elements of the preferred embodiment illustrated in FIGS. 1–6.

DESCRIPTION OF THE PREFERRED EMBODIMENT

Referring now to the FIGURES accompanying this description and in which reference characters therein correspond to the numerals hereinafter, FIGS. 1–6 illustrate the preferred embodiment of the invention. The tobacco pipe 10, FIG. 1, comprises a stem 12 having a bore 13, FIG. 6, through which smoke is inhaled in use of the pipe, including a threaded end portion 14, FIG. 6, opposite its mouth-portion end 16. Portion 14 is threaded to corresponding threads 17 forming an opening 18 through the wall or periphery 19, FIG. 6, of a cylindrical manifold 20 in the assembly of the illustrated five (5)

Figure 1:
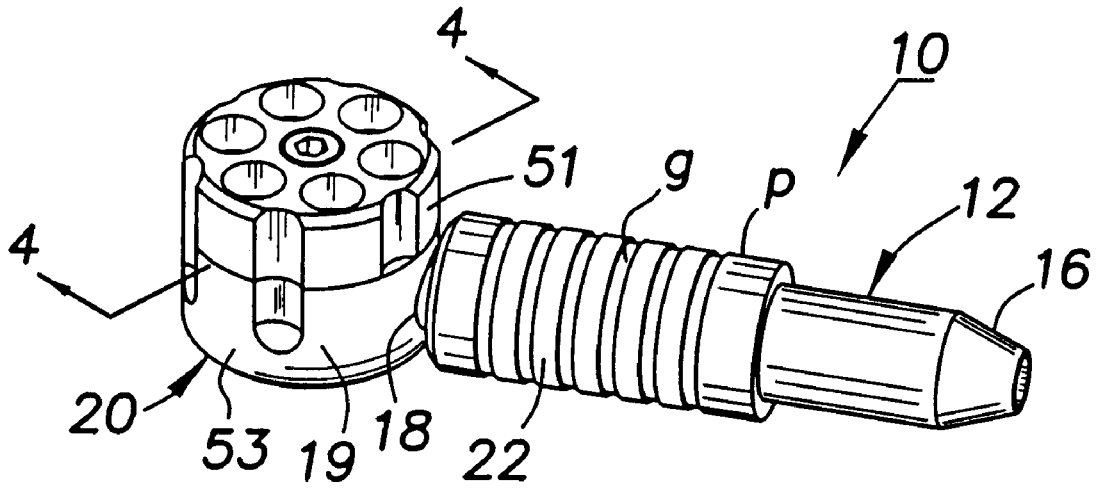
FIG. 1 is a perspective view of the preferred embodiment of the invention in a metal tobacco pipe.
Figure 3:
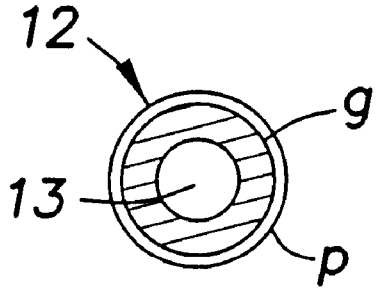
FIG. 3 is a view taken on line 3—3 of FIG. 2.

10 tobacco pipe, FIG. 1
11
12 stem
13 bore, FIG. 6
14 threaded end portion, FIG. 6
15
16 mouth-end portion
17 threads in 18, FIG. 6
18 opening in 19, FIGS. 1, 6
19 periphery/wall in 20, FIGS. 1, 6
20 cylindrical manifold
21
22 main body of 12
p periphery on 22
g grooves in 22
23
24 chamber in 30, FIGS. 5, 6
25 port, FIG. 5
26 top wall of 20, FIGS. 5, 6
27 recess in 25
28 screen
29 bottom wall of 30, FIGS. 5
30 turret
31 cylindrical body, FIG. 4
32 axis, FIG. 6
33 magazines/chambers
34 shelf
35 passage way
36 axis, FIG. 6
37 member
38 cavity
39 top wall of 30
40
41 bearing surface on 30
42 bearing surface on 37
43 head on 37
44
45 bearing surface on 26, FIG. 4
46 bearing surface under 47
47 central portion on 37
48 threads on 20 in 38, FIG. 4
49 threads on 37
50 fluted surfaces in 30
51 periphery in 30
52 fluted surfaces elements of pipe 10. End portion 14 , FIG. 6, is reduced in size from the main body 22 of stem 12 to a suitable size for threading to threads 17, while the mouth-portion end 16 is of a size suitable to the person inhaling tobacco smoke through the bore 13 of stem 12. It is to be noted that main body 22 of stem 12 includes an enlarged periphery p, the periphery p being reduced in spaced intervals along the length of main body 22 to produce a series of grooves g. The purpose of the enlargement of periphery p over other portions of stem 12 is to produce a greater surface area for dissipation of heat generated in the smoking or inhaling of the smoke through stem 12. The grooved arrangement g not only provides additional surface area for more dissipation of heat, but also provides for a better gripping function for the person smoking pipe 10.

Manifold 20 includes a chamber 24, FIGS, 5, 6, communicable with opening 18 in wall 19. A port 25, FIG. 5, formed in the body formation for a top wall 26, FIGS. 5, 6, of manifold 20 communicates with chamber 24 and is recessed as at 27 for seating therein of a screen 28 for filtering smoke from tobacco passing into chamber 24 and bore 13. The recess 27 removes interference between screen 28 and the bottom wall 29 of a turret 30 rotatably mounted atop manifold 20.

Turret 30 comprises a cylindrical body 31 mounted in axial alignment, as by an axis 32, FIG. 6, on its manifold 20 disposed below it. Turret 30 includes a plurality of tobacco-smoking magazines or chambers 33 equally spaced from one another in a circumferential manner while being located equidistant along their respective radii from axis 32. Each magazine 33 includes a wide shelf 34 for capturing deposits of spent tobacco without gravitating through a passage way 35 in turret 30 extending between a serially-aligned magazine 33 and port 25 in manifold 20. Body 31 is of substantial thickness in its material about chambers 33 to eliminate oxidation leading to an unpleasant metal taste by a flame igniting a chamber's tobacco. Each magazine 33 is adapted to serially align with the manifold's chamber 24 below port 25 in the smoking operation of the pipe, as indicated by an axis 36, FIG. 6, that extends through the centers of the body formation of chamber 24 and a serially-aligned magazine 33 over port 25.

Turret 30 is joined to manifold 20 by means of a member 37, FIGS. 4, 6, 7, situated within a cavity 38 co-extensive to turret and manifold. Cavity 38 is formed in alignment with axis 32, extending from the top wall 39, FIG.5, of and through turret 30 and through top surface 26 of and into the cylindrical body of manifold 20. In the body formation for cavity 38, a bearing surface or shoulder 41 forms cavity 38 in its portion within turret 30, and a bearing surface or shoulder 42 is formed on the underside of a head 43 on member 37, FIG. 7. The abutment of these bearing surfaces or shoulders 41, 42 against one another in the assembly of member 37 to pipe 10 prevents a binding between turret and manifold so that they readily rotate about each other. Another pair of abutting bearing surfaces 45, 46, FIGS. 4, 7, are generated or formed, the one, 45, FIG. 4, on the top surface 26 of manifold 20 and the other, 46, FIG. 7, on the underside of a central portion 47 of member 37, respectively, to provide an additional means to assure a non-binding relationship between turret and manifold. It is to be noted that in the preferred embodiment of pipe 10, turret 30, manifold 20, member 37 and the geometrical configuration for cavity 38 are precision ground in their dimensions so that in the fitting of member 37 to cavity 38, in the assembly of pipe 10, the bearing surface 42 on the underside of head 43 of member 37 mates with the bearing surface 45 formed on top wall 26 of manifold 20, to advantageously eliminate any wobble of member 37, and thus providing a true non-binding relationship between turret and manifold. Head 43 is preferably configured for an Allen wrench application for ease of assembly and disassembly of pipe 10.

Cavity 38 continues to extend further into the body of manifold 20, being formed by threads 48, FIG. 4, so that threads 49, FIG. 7, on member 37, cooperate with the threads 48, to fasten together turret 30 to manifold 20 in their joining together of turret and manifold in assembly of pipe 10.

Turret 30 includes indicia or a series of one or more fluted walls or surfaces 50, FIG. 5, equally spaced from one another along its periphery 51. Manifold 20 includes indicia or a series of one or more fluted walls or surfaces 52 in its wall or periphery 19, but having a lesser number than those in turret 30 view of the assembled location of stem 12 to manifold 20. The indicia 50, 52 are arranged or positioned about manifold and turret so that by registering them together, preferably manually by touch, or by sight or other reasonable way, any desired one of the turret's chambers 33 is aligned or centered over port 25 and chamber 24 in manifold 20.

The weight of the material, such as brass, of turret 30 is greater than the weight of the material, such as aluminum, for manifold 20, the reason for which being described below in the operation of tobacco pipe 10.

Stem 12 is fabricated from aluminum and member 37 is made of stainless steel that is precision ground, having an Allen-wrench head 43 on it for ease of assembly and disassembly of the pipe. Screen 28 is made from brass mesh. These five elements of the preferred embodiment are first fabricated by Known machining operations and techniques on their respective materials, prior to assembly.

In assembly, screen 28 is seated in recess 27 at port 25. Turret 30 is mounted upon manifold 20 about axis 32. Member 37 is inserted through cavity 38 within both turret and manifold, and with the use of an Allen wrench, member 37 is turned while its thread portion 49 cooperates with threads 48 forming cavity 30 in manifold 20. The bearing surfaces 41, 42 and 45, 46 abut their corresponding ones upon threading member 37 to manifold 20, thereby providing a non-binding fit to the rotation of turret to manifold. Stem 12 then is threaded to manifold 20 by means of threaded end portion 14 being threaded to threads 17 in manifold 20. Disassembly is accomplished by unscrewing member 37, unthreading stem 12 from manifold 20, and removing screen 28 from its recess 27, resulting in the separation of the elements from one another.

In operation, each of the magazines 33 is filled with tobacco, although all need not be filled concurrently with one another. By either sense of touch or sight, a fluted surface 50 in turret 30 is aligned with a fluted surface 52 in manifold 20 by rotation of turret to manifold so that the desired one of the chambers 33 having tobacco in it may be co-incident to the axis 36 that extends through the center of the manifold chamber 24. Pipe 10 is now ready for preparation of lighting the desired tobacco in the usual manner for smoking a pipe. The heavier weight of turret 30 maintains its position upon the less-weighted manifold 20 whereby the desired tobacco-filled magazine 33 disposed over port 25 remains stationary thereover, so that smoking may be continuous and inhaled through the mouth-end portion 16 on stem 12. The sufficient and additional thicknesses of stem 12 over the size of its bore 13 provides the manner by which excessive or uncomfortably-sensed heat to the hand (not shown) holding pipe 10 is readily dissipated without the hand feeling uncomfortable to the smoker while smoking and inhaling, and in the preferred embodiment the peripheries p and grooves g provide the additional gripping function as well.

The tobacco filling the desired chamber 33 is in the usual manner inhaled at the stem's end 16. As ash and/or residue accumulates from the burned tobacco, it settles on shelf 34 of magazine 33 rather than gravitating through passageway 35 to and through screen 28 into the manifold's chamber 24 and the stem's bore 13. It is to be noted that the position of screen 28 is located a substantial distance at the one end of passageway 35, away from top wall 39, so that it is spaced sufficiently from the source of the flame, i.e., of either a lighter or match or the burning tobacco itself, thereby eliminating scorching of the screen and adding to its life. Residue from the ashes that otherwise would accumulate on screen 28 were it closer to the magazine 33 is not baked or otherwise caused to adhere to the mesh forming screen 28, such spacing thereby contributing to a longer life for the screen, to less clogging that would otherwise occur as in the use of other metal pipes, and to the cleaning of the pipe's elements at most infrequent intervals of time. The hollowness (bore 13) of stem 12, though small relative to the diameter or diameter of stem 12, is large enough that it never gets clogged and in view of such fact a "seasoned" effect may be achieved for pipe 10.

Various modifications and changes may be made in the preferred and any other embodiment of the invention without affecting the spirit and scope of the appended claims hereto. For example,.bearing surfaces 45, 46 may be omitted, however, preferred in the herein illustrated embodiment, pipe 10 being a precisely machined article in regard to these bearing surfaces as well.

I claim:

1. A metal tobacco pipe in its assembly comprising a manifold having a body formation forming a port and a chamber communicating with said port and a recess in the body formation of said port, a stem having a bore through which tobacco smoke is inhaled, said stem communicating with said chamber, a turret having a plurality of magazines rotatably mounted on said manifold, each of said magazines communicable and alignable with said port and chamber by rotation of said turret to said manifold, means for filtering tobacco smoke from tobacco in an aligned one of said magazines to said port and chamber seated in said recess, means co-extensive in and between said turret and manifold forming a cavity, and means joining together said turret and manifold disposed in the cavity, said joining means comprising a member having a first bearing surface formed therein, a second bearing surface formed in said turret abutting said first bearing surface, whereby the abutment between said first and second bearing surfaces provides a non-binding relationship between said turret and manifold, and means below said first bearing surface for fastening said turret to said manifold, whereby any one of said magazines aligned to said port and chamber upon rotation of turret to manifold provides for inhalation of tobacco smoke through said bore of said stem wherein said turret is of heavier weight than the weight of said manifold, such that said turret remains in a stationary upon said manifold in any particular relative rotation between said turret and said manifold.

2. The metal tobacco pipe of claim 1 wherein said filtering means comprises a screen.

3. The metal tobacco pipe of claim 1 wherein said manifold includes a recess in the body formation of its port, said screen seated in said recess.

4. The metal tobacco pipe of claim 1 wherein said turret is made from brass and said manifold is made from aluminum.

5. The metal tobacco pipe of claim 4 including indicia on said turret and said manifold which when registered to one another indicates that one of said magazines in said turret is aligned and communicating with said chamber in said manifold.

6. The metal tobacco pipe of claim 5 wherein said indicia comprises a series of fluted surfaces in said turret and in said manifold for registry with one another.

7. The metal tobacco pipe of claim 1 including a wide shelf in at least one of said magazines for capturing ash or residue formed by burning tobacco in said one of said magazines.

8. The metal tobacco pipe of claim 1 including an enlarged stem for dissipating heat arising out of smoking said pipe.

9. The metal pipe of claim 8 including a grooved arrangement on said enlarged stem for further dissipation of heat and for providing a better grip to said pipe while smoking.

10. The metal tobacco pipe of claim 1 including a second set of bearing surfaces, the first of said surfaces in said second set formed in said joining means above said fastening means and the second of said surfaces in said second set formed on said manifold, said second set of surfaces abutting one another in the assembly of said tobacco pipe.

11. In a metal tobacco pipe having a hollow stem communicating with a manifold that includes a chamber for communicating with one of a plurality in a turret of magazines containing tobacco for smoking, the turret fastened to and rotatably mounted on said manifold, the improvement comprising the turret being of a heavier weight than that of the manifold so that both turret and manifold remain stationary relative to one another after relative rotation between them has taken place to communicate one of the magazines with the manifold's chamber.

12. In claim 11, the improvement including said turret made from brass and said manifold made from aluminum.

13. In claim 12, the improvement including filtering means situated on said manifold and below said one of the magazines communicating with the manifold's chamber below said filtering means.

14. The improvement of claim 13 wherein said filtering means comprises a screen, said manifold including a recess for seating said screen.

15. In claim the improvement including means co-extensive in and between said turret and manifold forming a cavity, and means joining together said turret and manifold disposed in the cavity, said joining means comprising a member having a first bearing surface formed therein, a second bearing surface formed in said turret abutting said first bearing surface, whereby the abutment between said first and second bearing surfaces provides a non-binding relationship between said turret and manifold, and means below said first bearing surface for fastening said turret to said manifold.

16. The metal tobacco pipe of claim 1 including a substantial thickness of material of said turret about said magazines to eliminate oxidation leading to an unpleasant metal taste by a flame igniting a chamber's tobacco.

17. The metal tobacco pipe of claim 1 including a substantial thickness of material of said turret about said magazines to eliminate oxidation leading to an unpleasant metal taste by a flame igniting a chamber's tobacco.

18. The metal tobacco pipe of claim including a substantial thickness of material of said turret about said magazines to eliminate oxidation leading to an unpleasant metal taste by a flame igniting a chamber's tobacco.

* * * * *

UNITED STATES PATENT AND TRADEMARK OFFICE

CERTIFICATE OF CORRECTION

PATENT NO. : 6,418,936 B1
DATED : July 16, 2002
INVENTOR(S) : Jake Lee

It is certified that error appears in the above-identified patent and that said Letters Patent is hereby corrected as shown below:

Column 8,
Line 11, after "claim" read -- 11 --;
Line 33, after "claim" read -- 4 --.

Signed and Sealed this

Twentieth Day of May, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,418,936 B1
APPLICATION NO. : 09/570114
DATED : July 16, 2002
INVENTOR(S) : Jake Lee It is certified that error appears in the above-identified patent and that said Letters Patent is hereby corrected as shown below:

In column 8, line 11, after "claim" read -- 11 --; line 33, after "claim" read -- 4 --.

Signed and Sealed this

Twenty-sixth Day of June, 2007

JON W. DUDAS
*Director of the United States Patent and Trademark Office*

UNITED STATES PATENT AND TRADEMARK OFFICE

CERTIFICATE OF CORRECTION

PATENT NO. : 6,418,936 B1
APPLICATION NO. : 09/570114
DATED : July 16, 2002
INVENTOR(S) : Jake Lee It is certified that error appears in the above-identified patent and that said Letters Patent is hereby corrected as shown below:

Title Page

Delete "(73) Assignee: Sandia Corp., Livermore, CA (US)"
In column 3, line 9, delete the comma ","
lines 10-53, delete all of these lines;
line 54, delete "52 fluted surfaces".

In column 5, line 27, "30" should read -- 38 --.

In column 6, its actual line 54, before "upon" insert -- position --.

In column 8, its actual line 11, after "claim" insert -- 11 --; its actual line 33, after "claim" insert -- 4 --.

This certificate supersedes the Certificates of Correction issued May 20, 2003 and June 26, 2007.

Signed and Sealed this

Fifteenth Day of January, 2008

JON W. DUDAS
*Director of the United States Patent and Trademark Office*